US009716949B2

(12) United States Patent
Zhou et al.

(10) Patent No.: US 9,716,949 B2
(45) Date of Patent: Jul. 25, 2017

(54) PANEL-FORM LOUDSPEAKER

(71) Applicants: Rongguan Zhou, Shenzhen (CN); Hongxing Wang, Shenzhen (CN); Lubin Mao, Shenzhen (CN)

(72) Inventors: Rongguan Zhou, Shenzhen (CN); Hongxing Wang, Shenzhen (CN); Lubin Mao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 105 days.

(21) Appl. No.: 14/514,566

(22) Filed: Oct. 15, 2014

(65) Prior Publication Data

US 2015/0201257 A1 Jul. 16, 2015

(30) Foreign Application Priority Data

Jan. 10, 2014 (CN) ..... 2014 2 0017331 U

(51) Int. Cl.

| | |
|---|---|
| ***H04R 1/02*** | (2006.01) |
| ***H04R 7/04*** | (2006.01) |
| *H04R 7/10* | (2006.01) |
| *H04R 17/00* | (2006.01) |

(52) U.S. Cl.

CPC ..... *H04R 7/045* (2013.01); *H04R 7/10* (2013.01); *H04R 17/00* (2013.01); *H04R 2499/11* (2013.01)

(58) Field of Classification Search

CPC ..... H04R 1/02
USPC ..... 381/388, 380
See application file for complete search history.

(56) References Cited

U.S. PATENT DOCUMENTS

| | | | | |
|---|---|---|---|---|
| 5,517,574 A * | 5/1996 | Tichy | H04M 1/0202 | 381/386 |
| 2005/0025330 A1* | 2/2005 | Saiki | H04R 7/04 | 381/388 |
| 2009/0154756 A1* | 6/2009 | Eaton | H04M 1/0277 | 381/388 |
| 2010/0061577 A1* | 3/2010 | Yeates | H04R 17/00 | 381/337 |

* cited by examiner

*Primary Examiner* — Duc Nguyen
*Assistant Examiner* — Phan Le
(74) *Attorney, Agent, or Firm* — Na Xu; IPro, PLLC

(57) ABSTRACT

A panel-form loudspeaker is disclosed. The panel-form loudspeaker includes a lower cover including a recess, and a vibration acoustic unit facing the recess with a periphery thereof fixed on the lower cover for actuating the lower cover to vibrate and generate sound.

5 Claims, 8 Drawing Sheets

PANEL-FORM LOUDSPEAKER

FIELD OF THE INVENTION

The present invention relates to a speaker apparatus, and particularly, to a panel-form loudspeaker for an electronic device using a back cover thereof as a vibration plate for generating audible sounds.

DESCRIPTION OF RELATED ART

Development of communication technologies and increase in users' requirements have recently enabled mobile communication terminals to provide multimedia functions such as music, videos, games, and the like in addition to the typical calling function. In order to provide these and other multimedia functions, the terminal is equipped with a highly functional loudspeaker independently of a typical receiver speaker. The loudspeaker includes one or two circular speakers with a diameter of approximately 10~15 mm, and is generally mounted in a case or in a hinge unit in case of a folder-type terminal. Generally, this kind of loudspeaker includes a membrane driven by a voice coil. However, the size of the loudspeaker is limited, typically to the diameter of 10~15 mm As a result, the frequency response of the loudspeaker is also limited, especially in a frequency region under 700 Hz (low frequency sound). As the vibration plate of the speaker becomes smaller, the reproducing frequency response characteristic is moved toward higher frequencies. Lower frequency characteristics may be enhanced by installing speakers with larger diameters, but this option is limited due to the devices themselves getting smaller and smaller.

For solving the problems mentioned above, a panel-form loudspeaker using the display of a mobile device to generate sounds is developed. This kind of loudspeaker generally includes a display and an actuator driving the display to vibrate, by which audible sounds with low frequency is accordingly generated. Compared with the conventional speaker, membrane and voice coil are displaced by the display and the actuator. The display includes a glass plate on the most top thereof and the glass plate is easy to be broken by the vibration of the actuator. Further, it is too difficult to improve the sound performance generated by the display because the display cannot be adjusted once the display is fixed.

Therefore, an improved panel-form loudspeaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

In an embodiment of the present invention, a panel-form loudspeaker is provided for a mobile communication terminal capable of effectively reproducing sound in a low frequency region by using a back cover or a front cover of the terminal as a vibration plate. While a mobile communication terminal is discussed for simplicity, the embodiment of the invention are capable of being applied to any type of mobile devices, for example PDAs, mobile phones, tablets, notebooks, and MP3 players, where it is preferred to keep the overall dimensions of the mobile devices themselves to a minimum.

Figure 1:
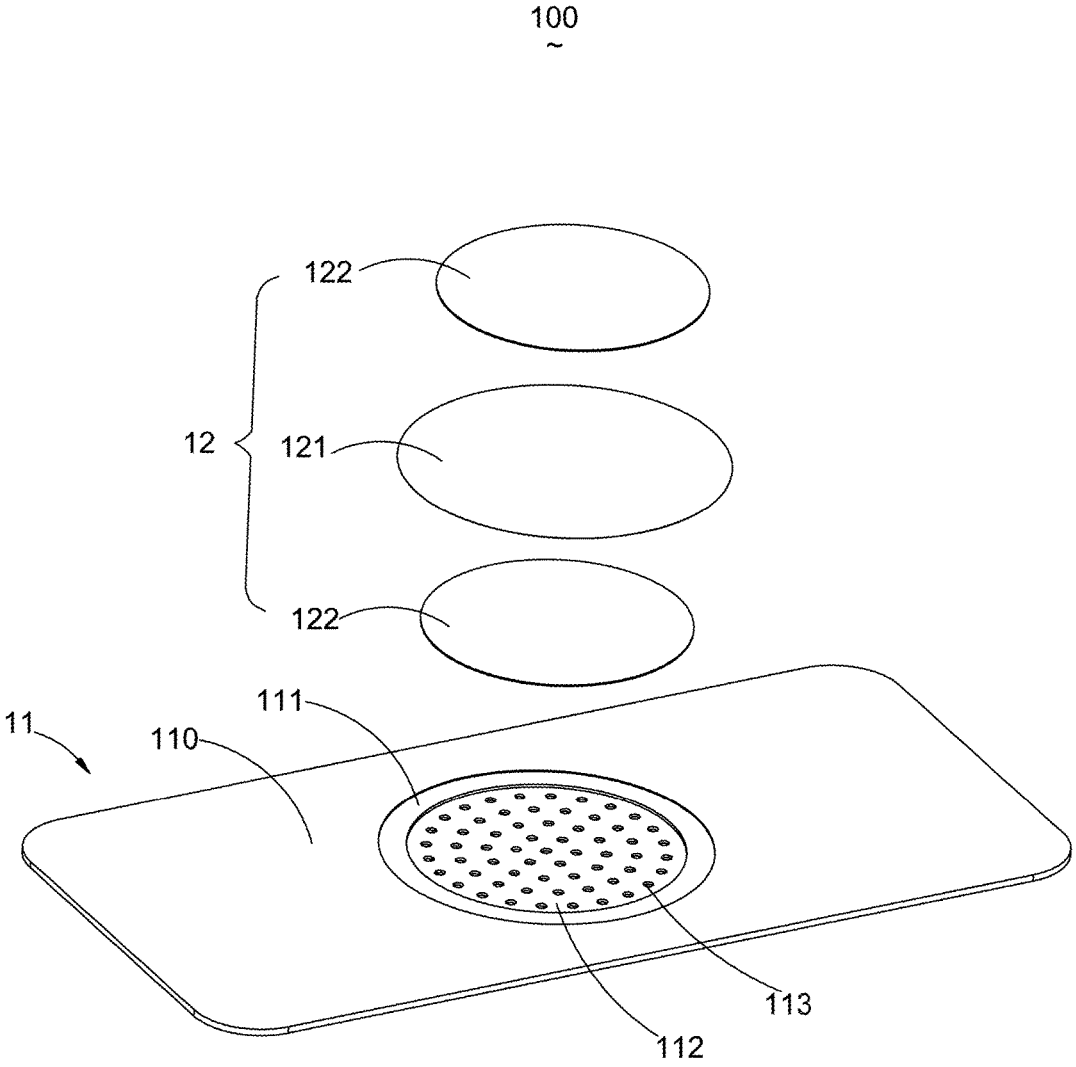
FIG. 1 is an exploded view of a panel-form loudspeaker according to a first embodiment of the present disclosure.
Figure 2:
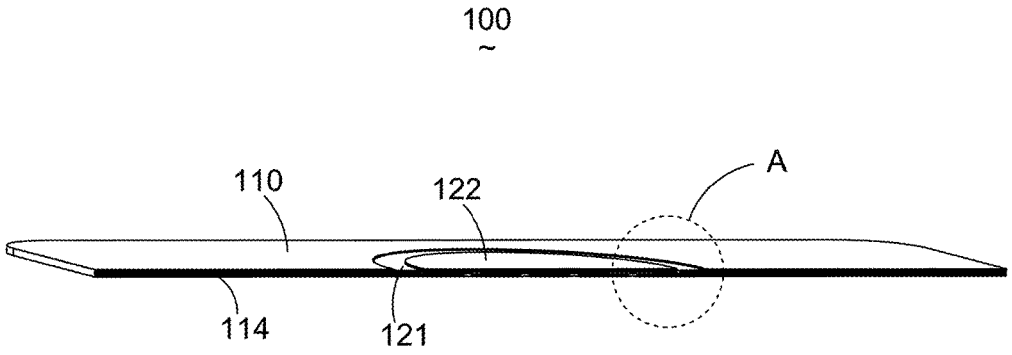
FIG. 2 is a cross-sectional view of the panel-form loudspeaker shown in FIG. 1.
Figure 3:
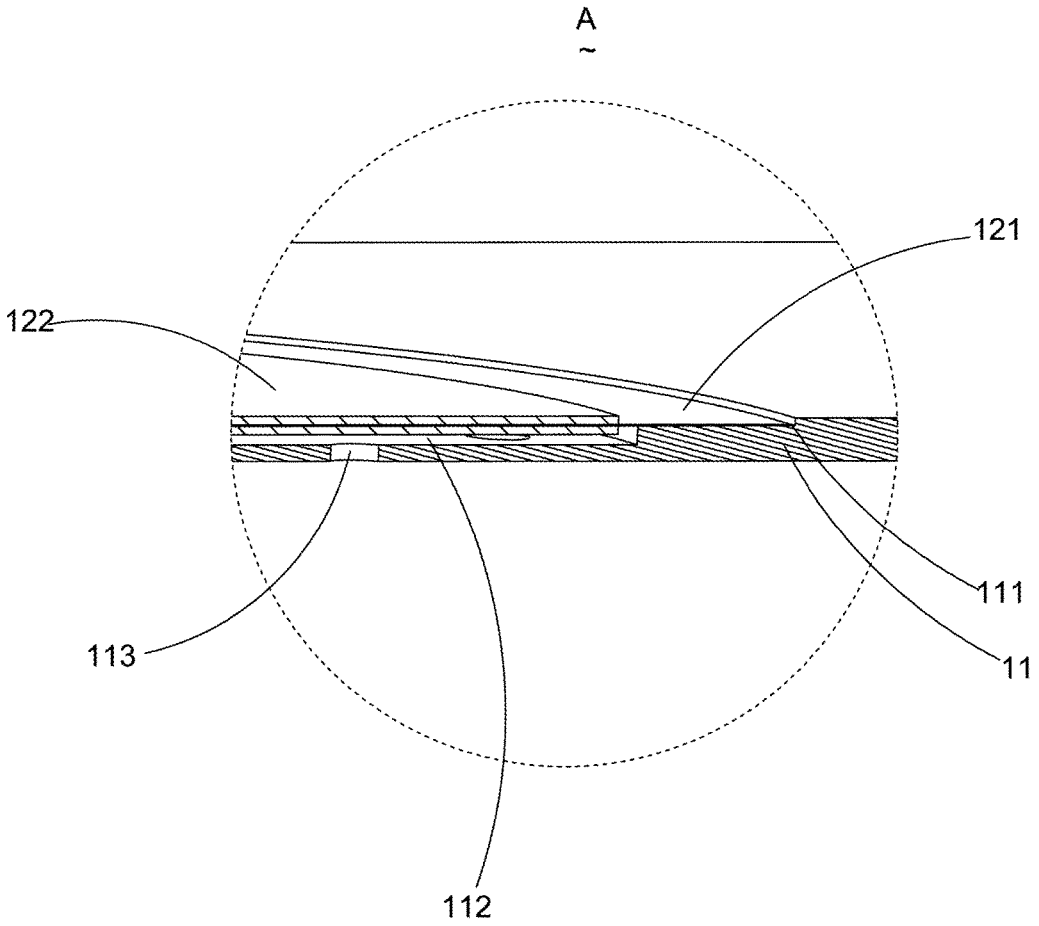
FIG. 3 is an enlarged view of circled part A of FIG. 2.

Referring to FIGS. 1-3, a panel-form loudspeaker 100 according to a first embodiment of the present disclosure comprises a lower cover 11 and a vibration acoustic unit 12 fixed on the lower cover 11 for actuating the lower cover 11 to vibrate and generate sound.

The lower cover 11 comprises an outer surface 114 disposed outside and an inner surface 110 opposite to the outer surface 114. A recess 112 depressed from the inner surface 110 to the outer surface 114 is formed on the lower cover 11. Preferably, the recess 112 is located in the center of the lower cover 11. A stepped portion 111 is formed on the lower cover 11 by the inner surface 110 depressing toward the outer surface 114 and surrounds around the recess 112 for connecting with a periphery of the vibration acoustic unit 12. A depth of the stepped portion 111 is less than that of the recess 112 in a thickness direction of the lower cover 11. The term "thickness direction" means that a vertical direction extends from the inner surface 110 toward the outer surface. The stepped portion 111 may be but not limited to ring-shaped, as long as the stepped portion 111 surrounds the recess 112. Additionally, a sound hole 113 penetrating the lower cover 11 from the outer surface 114 to the inner surface 110 is formed on the lower cover 11 part on which the recess 112 is formed for transmitting the sound. The shape and number of the sound hole(s) are not particularly restricted. There may be a plurality of sound holes and the sound hole may have any shape such as rectangle or circle.

The vibration acoustic unit 12 comprises a diaphragm 121 and at least one piezoelectric plate 122 attached to the diaphragm 121 and supported by the diaphragm 121 for driving the diaphragm 121 to vibrate. The diaphragm 121 is made of membrane material for generating sound and for amplifying the vibration amplitude of the piezoelectric plate 122. The diaphragm 121 and piezoelectric plate 122 may be but not limited to disk-shaped. An area of the diaphragm 121 is substantially greater than that of the piezoelectric plate 122, and the piezoelectric plate 122 is positioned in a center of the diaphragm 121. In this embodiment, there are two piezoelectric plates 122 attached to both sides of the diaphragm 121 respectively.

When assembled, the diaphragm 121 faces the recess 112 with a periphery thereof fixing to the stepped portion 111 by normal means such as glue or adhesive. The piezoelectric plate 122 attached to a side of the diaphragm 121 facing the lower cover 11 is received in the recess 112. While electric signal is applied to the piezoelectric plate 122, the diaphragm 121 is activated to vibrate. Accordingly, the lower cover 11 is driven by the diaphragm 121 to vibrate, and sounds are thus produced.

Figure 4:
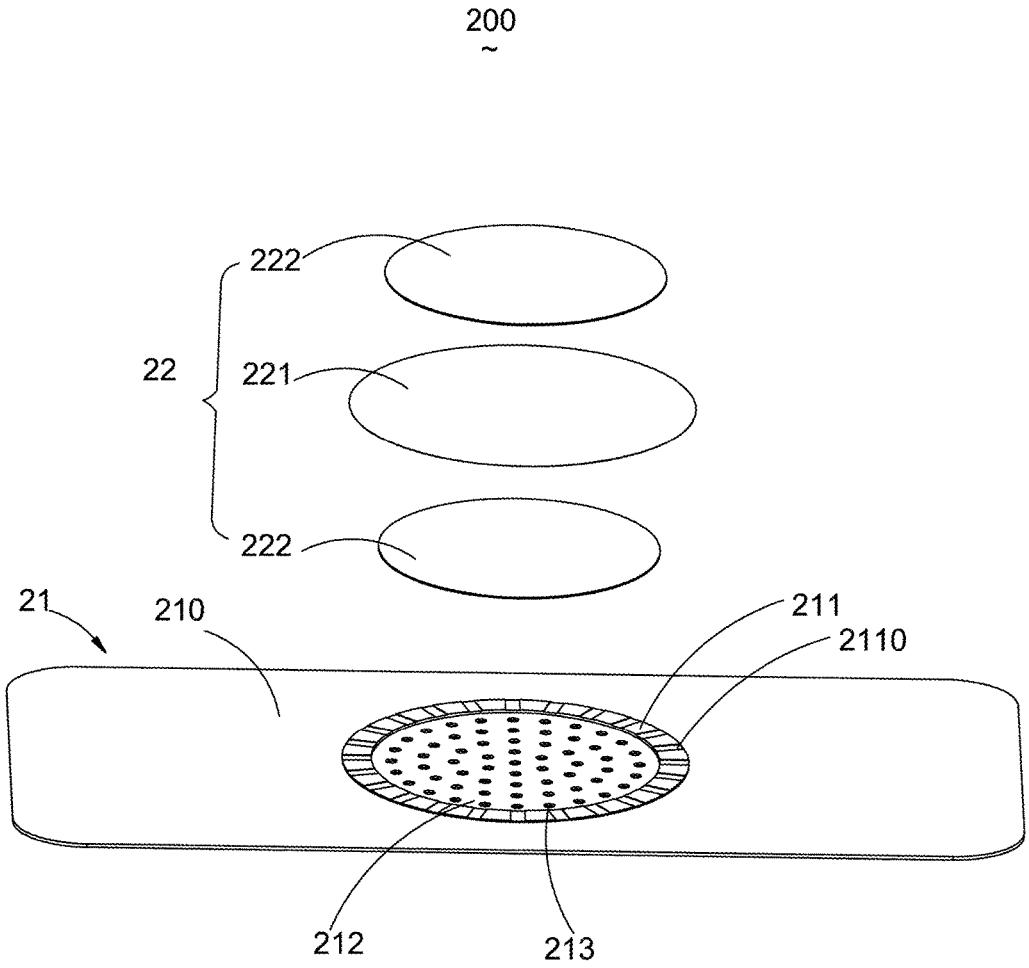
FIG. 4 is an exploded view of a panel-form loudspeaker according to a second embodiment of the present disclosure.
Figure 5:
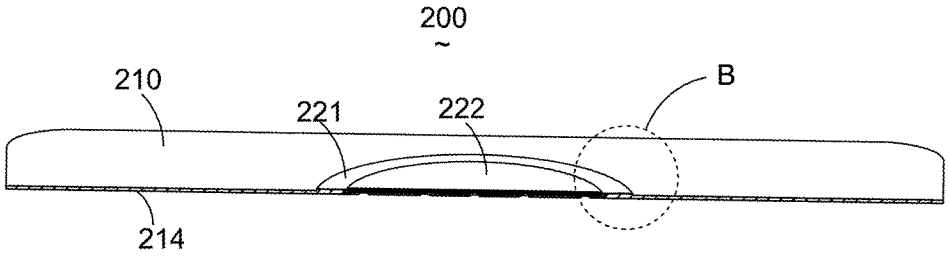
FIG. 5 is a cross-sectional view of the panel-form loudspeaker shown in FIG. 4.
Figure 6:
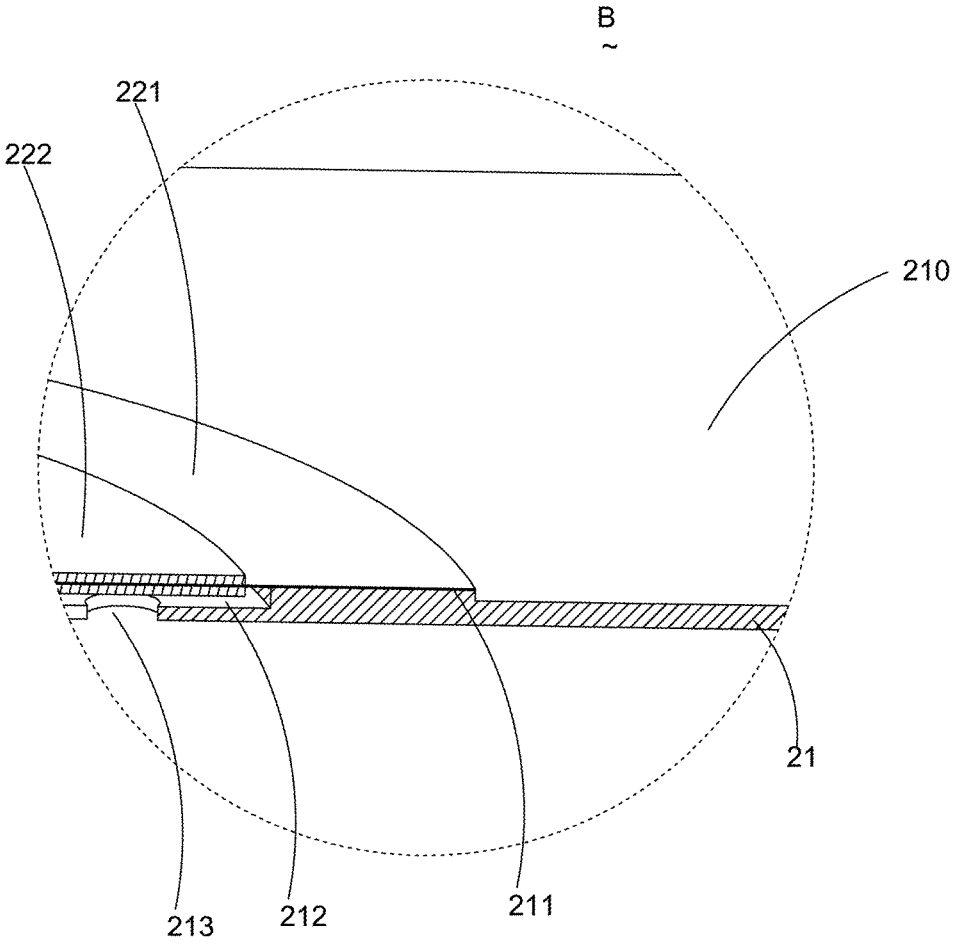
FIG. 6 is an enlarged view of circled part B of FIG. 5.
Figure 7:
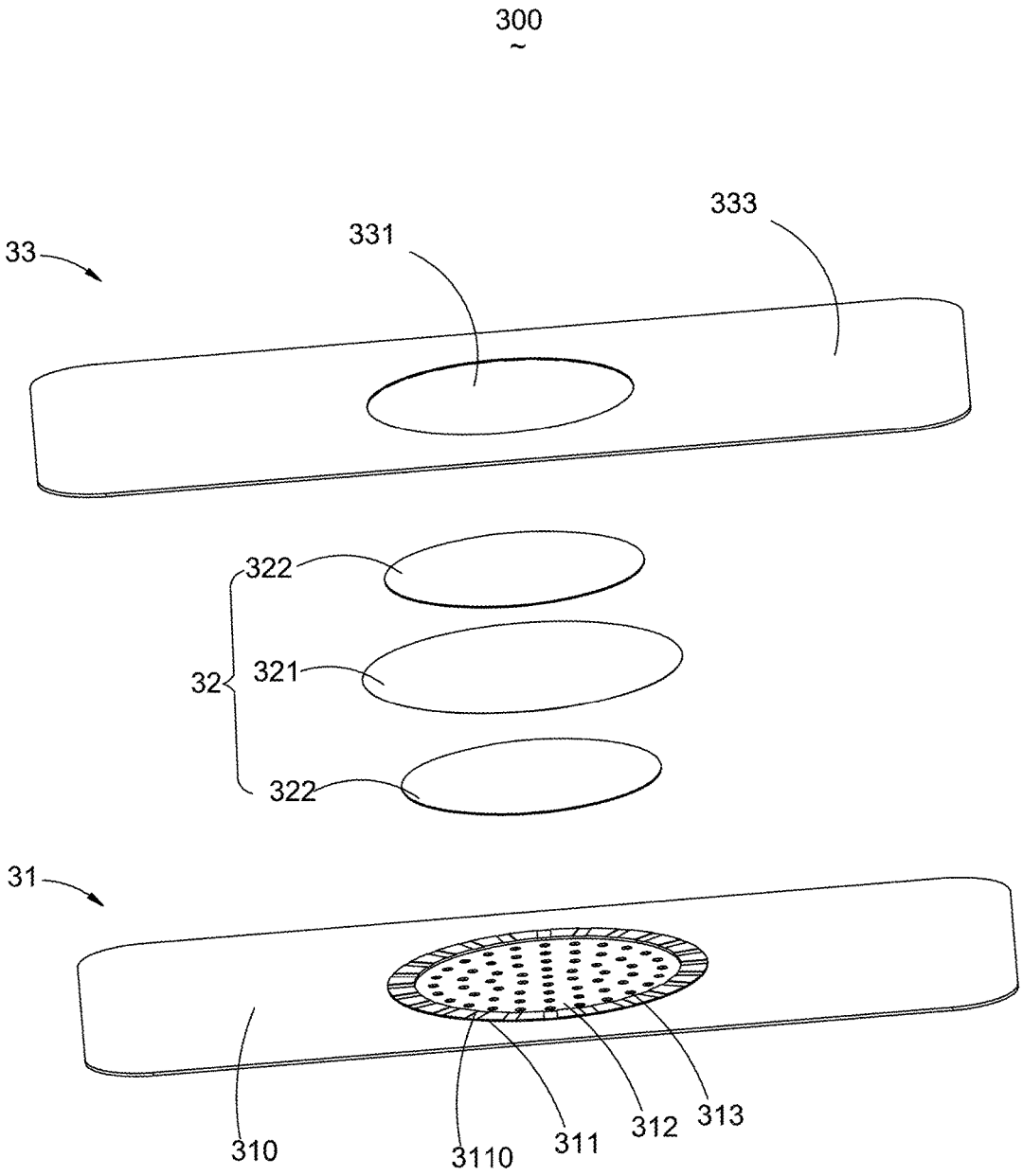
FIG. 7 is an exploded view of a panel-form loudspeaker according to a third embodiment of the present disclosure.
Figure 8:
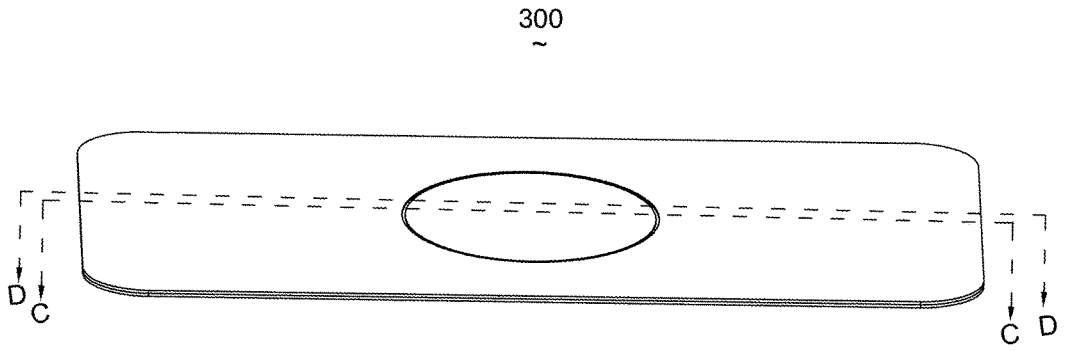
FIG. 8 is an illustrative assembled view of the panel-form loudspeaker shown in FIG. 7.
Figure 9:
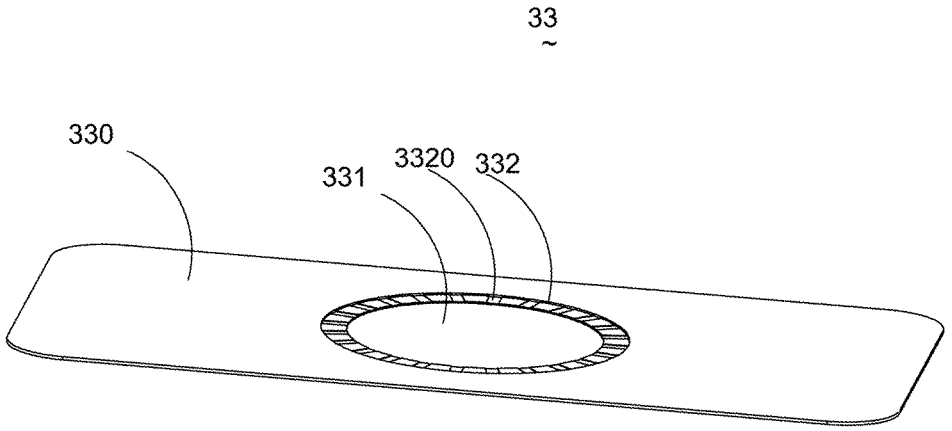
FIG. 9 is an illustrative isometric view of an upper cover of the panel-form loudspeaker shown in FIG. 7, but from another aspect.
Figure 10:
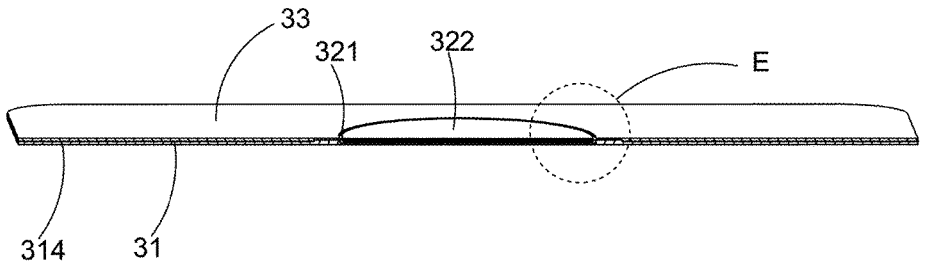
FIG. 10 is a cross-sectional view of the panel-form loudspeaker taken along line C-C of FIG. 8.
Figure 11:
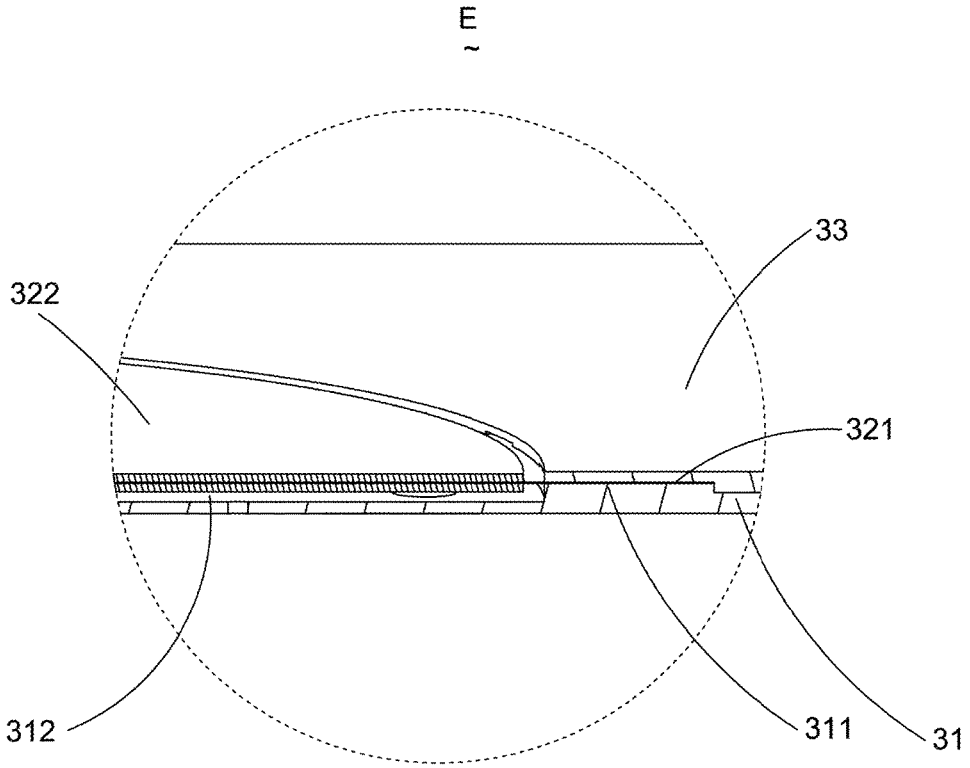
FIG. 11 is an enlarged view of circled part E of FIG. 10.
Figure 12:
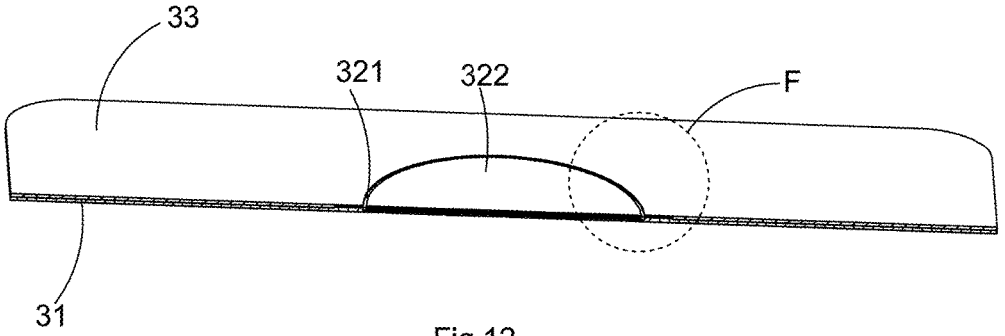
FIG. 12 is a cross-sectional view of the panel-form loudspeaker taken along line D-D of FIG. 8.
Figure 13:
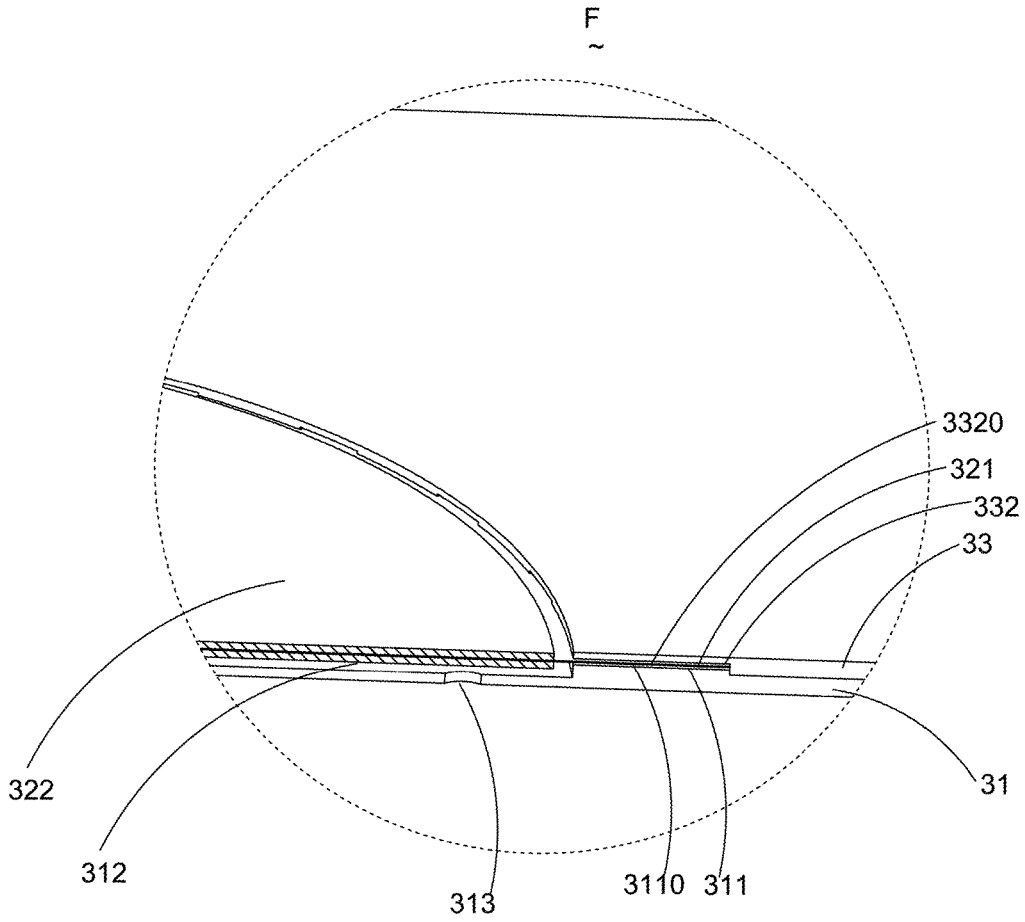
FIG. 13 is an enlarged view of circled part F of FIG. 12.

Referring to FIGS. 4-6, a panel-form loudspeaker 200 according to a second embodiment of the present invention comprises a lower cover 21 and a vibration acoustic unit 22 fixed to the lower cover 21 for actuating the lower cover 21 to vibrate and generate sound.

The vibration acoustic unit 22 comprises a diaphragm 221 and a pair of piezoelectric plate 222 attached to both sides of the diaphragm 221 respectively, which are identical to that of the first embodiment.

The second embodiment differs from the first embodiment in that the configuration of the lower cover 21 is different from that in the first embodiment. The lower cover 21 includes an outer surface disposed outside and an inner surface 210, which are identical to that in the first embodiment. A recess 212 is formed on the lower cover 21 with the same configuration as that of the first embodiment. A sound hole 213 is formed on the lower cover 21 with the same configuration as that in the first embodiment.

However, the lower cover 21 further includes a projection 211 protruding toward the vibration acoustic unit 22 from the inner surface 210 and surrounding the recess 212 for connecting with the vibration acoustic unit 22, by which the stepped portion 111 of the first embodiment is replaced.

The projection 211 is substantially ring-shaped, and integrated with the lower cover 21. In other embodiment, the projection 211 may be an independent element, which is attached to the inner surface 210 of the lower cover 21 by normal means such as glue or adhesive. A plurality of first slots 2110 are formed on the projection 211 and spaced from each other in a circumferential direction of the projection 211. With the configuration of the first slots, it is convenient for injecting glue so that the diaphragm 221 can be mounted on the inner surface 210 of the lower cover 21 easily.

When assembled, the diaphragm 221 faces the recess 212 with a periphery thereof fixed on the projection 211 by gluing. The piezoelectric plate 222 attached to a side of the diaphragm 221 facing the lower cover 21 is received in the recess 212. In such case, it supplies greater vibration space for the diaphragm 221, and thus can improve acoustic performance of the panel-form loudspeaker. While electric signal is applied to the piezoelectric plate 222, the diaphragm 221 is activated to vibrate. Accordingly, the lower cover 21 is driven by the diaphragm 221 to vibrate, and sounds are thus produced.

Referring to FIGS. 7-13, a panel-form loudspeaker 300 according to a third embodiment of the present invention comprises a lower cover 31, an vibration acoustic unit 32 attached to the lower cover 31 and an upper cover 33 including a receiving hole 331 and pressing a periphery of the vibration acoustic unit 32 for fixing the vibration acoustic unit 32 to the lower cover 31, with the vibration acoustic unit 32 partially received in the receiving hole 331.

The vibration acoustic unit 32 comprises a diaphragm 321 and a pair of piezoelectric plates 322 attached to both sides of the diaphragm 321 respectively, which are identical to that in the first embodiment and the second embodiment.

The lower cover 31 comprises an outer surface 314 disposed outside and an inner surface 310 opposite to the outer surface 314, which are identical to that of the second embodiment. The lower cover 31 defines a recess 312 and a projection 311 surrounding the recess 312, which are identical to that in the second embodiment. The projection 311 also defines a plurality of first slots 3110 same as that in the second embodiment.

The upper cover 33 comprises a lower surface 330 facing the lower cover 31 and an upper surface 333 opposite to the lower surface 330. The receiving hole 331 penetrates the upper cover 33 from the lower surface 330 to the upper surface 333 and is disposed so that the centers of the recess 312, diaphragm 321 and the receiving hole 331 are aligned. An engaging groove 332 corresponding to the projection 311 of the lower cover 31 is formed on the lower surface 330 for receiving the projection 311. A plurality of second slots 3320 corresponding to the first slots 3110 one by one are formed on the lower surface 330 on which the engaging groove 332 is formed.

When assembled, the diaphragm 321 faces the recess 312 with a periphery thereof fixed on the projection 311 by gluing. The piezoelectric plate 322 attached to a side of the diaphragm 321 facing the lower cover 31 is received in the recess 312. The upper cover 33 presses the periphery of the diaphragm 321 with the piezoelectric plate 322 attached to a side of the diaphragm 321 away from the lower cover 31 received in the receiving hole 331. The projection 311 is received in the engaging groove 332 so that the periphery of the diaphragm 321 is sandwiched between the upper cover 33 and the lower cover 31. With such configuration, the diaphragm 321 can be firmly fixed on the lower cover 31. Meanwhile, each of the first slots 3110 and corresponding second slots 3320 corporately form an accommodating space (not numbered) for accommodating the injected glue so that the diaphragm 321 can be connected to the lower cover 31 and upper cover 33 by glue. While electric signal is applied to the piezoelectric plate 322, the diaphragm 321 is activated to vibrate. Accordingly, the lower cover 31 is driven by the diaphragm 321 to vibrate, and sounds are thus produced.

The panel-form loudspeaker has a lower cover and a vibration acoustic unit fixed on the inner surface of the lower cover, which is not exposed from the outside of the lower cover, thus can avoid the vibration acoustic unit being removed from the lower cover under larger exterior impact, or under the condition of failure in gluing.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A panel-form loudspeaker, comprising:

a lower cover including an outer surface and an inner surface opposite to the outer surface, a recess depressed from the inner surface toward the outer surface, and a projection protruding away from the outer surface and surrounding the recess; wherein, the projection defines a plurality of first slots in a top surface thereof, and the first slots are spaced from each other in a circumferential direction of the projection;

an vibration acoustic unit facing the recess, the vibration acoustic unit including a diaphragm with a periphery thereof fixed to the top surface of the projection and covering the first slots, and a pair of piezoelectric element attached to the both sides of the diaphragm for driving the diaphragm;

a plurality of sound holes penetrating the lower cover from the outer surface to the inner surface;

an upper cover including a receiving hole and pressing the periphery of the diaphragm for fixing the diaphragm to the top surface of the projection with the vibration acoustic unit partially received in the receiving hole; wherein, the upper cover comprises a lower surface facing the lower cover, an upper surface opposite to the lower surface, and an engaging groove corresponding to the projection formed on the lower surface for receiving the projection of the lower cover so that the diaphragm is fixed into the engaging groove by the projection; and a plurality of second slots corresponding to the first slots one by one formed on the lower surface on which the engaging groove is formed, and the second slots covered by the diaphragm.

2. A panel-form loudspeaker, comprising:

a lower cover including an outer surface disposed outside, an inner surface opposite to the outer surface, a recess formed on the inner surface and a projection formed on the inner surface, protruding away from the outer surface and surrounding the recess;

wherein, the projection defines a plurality of first slots in a top surface thereof, and the first slots are spaced from each other in a circumferential direction of the projection;

a vibration acoustic unit facing the recess with a periphery thereof fixed to the top surface of the projection for actuating the lower cover to vibrate and generate sound and covering the first slots;

an upper cover located above the lower cover and pressing the periphery of the vibration acoustic unit for fixing the vibration acoustic unit to the top surface of the projection, wherein, the upper cover includes an upper surface away from the lower cover and a lower surface opposite to the upper surface, a receiving hole that penetrates the upper cover from the lower surface to the upper surface for partially receiving the vibration acoustic unit therein, and an engaging groove corresponding to the projection formed in the lower surface for receiving the projection of the lower cover so that the vibration acoustic unit is fixed into the engaging groove by the projection; and the upper cover further provides a plurality of second slots corresponding to the first slots one by one formed in the lower surface in which the engaging groove is formed, and the second slots covered by the vibration acoustic unit.

3. The panel-form loudspeaker of claim 2, wherein at least one sound hole is formed in the lower cover in which the recess is formed.

4. The panel-form loudspeaker of claim 1, wherein each of the first slot and the second slot corresponding to the first slot corporately form an accommodating space for accommodating injected glue so that the diaphragm is fixed between the lower cover and the upper cover by glue.

5. The panel-form loudspeaker of claim 2, wherein each of the first slot and the second slot corresponding to the first slot corporately form an accommodating space for accommodating injected glue so that the diaphragm is fixed between the lower cover and the upper cover by glue.

* * * * *